US009915902B2

(12) United States Patent
Hamada et al.

(10) Patent No.: US 9,915,902 B2
(45) Date of Patent: Mar. 13, 2018

(54) IMAGE FORMING APPARATUS, METHOD, NON-TRANSITORY COMPUTER READABLE MEDIUM, AND DETACHABLE BODY

(71) Applicant: FUJI XEROX CO., LTD., Tokyo (JP)

(72) Inventors: Hirofumi Hamada, Ebina (JP); Shinya Makiura, Ebina (JP); Eiji Nittono, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/239,281

(22) Filed: Aug. 17, 2016

(65) Prior Publication Data

US 2017/0242381 A1 Aug. 24, 2017

(30) Foreign Application Priority Data

Feb. 19, 2016 (JP) ..... 2016-030380

(51) Int. Cl.
*G03G 15/00* (2006.01)
*G03G 21/00* (2006.01)
*G03G 15/02* (2006.01)

(52) U.S. Cl.
CPC ..... *G03G 15/50* (2013.01); *G03G 15/0266* (2013.01); *G03G 15/55* (2013.01); *G03G 21/0005* (2013.01); *G03G 21/0011* (2013.01)

(58) Field of Classification Search
CPC . G03G 15/50; G03G 21/0005; G03G 2215/02
See application file for complete search history.

(56) References Cited

U.S. PATENT DOCUMENTS

2007/0047988 A1* 3/2007 Comstock ..... G03G 15/1675 399/66
2007/0160377 A1* 7/2007 Sakuwa ..... G03G 15/0266 399/50

FOREIGN PATENT DOCUMENTS

JP H11-194557 A 7/1999
JP 2009-288481 A 12/2009
JP 2012226125 A * 11/2012

* cited by examiner

*Primary Examiner* — Ryan Walsh
(74) *Attorney, Agent, or Firm* — Oliff PLC

(57) ABSTRACT

An image forming apparatus includes an image carrier, a cleaning member that cleans the image carrier, an image forming unit that forms an image on a recording material, and a controller that controls the image forming unit based on at least one of physical property information and dimension information of the cleaning member.

7 Claims, 2 Drawing Sheets

IMAGE FORMING APPARATUS, METHOD, NON-TRANSITORY COMPUTER READABLE MEDIUM, AND DETACHABLE BODY

CROSS-REFERENCE TO RELATED APPLICATIONS

This application is based on and claims priority under 35 USC 119 from Japanese Patent Application No. 2016-030380 filed Feb. 19, 2016.

BACKGROUND

Technical Field

The present invention relates to an image forming apparatus, a method, a non-transitory computer readable medium, and a detachable body.

SUMMARY

According to an aspect of the invention, an image forming apparatus includes an image carrier, a cleaning member that cleans the image carrier, an image forming unit that forms an image on a recording material, and a controller that controls the image forming unit based on at least one of physical property information and dimension information of the cleaning member.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described below with reference to the accompanying drawings.

Figure 1:
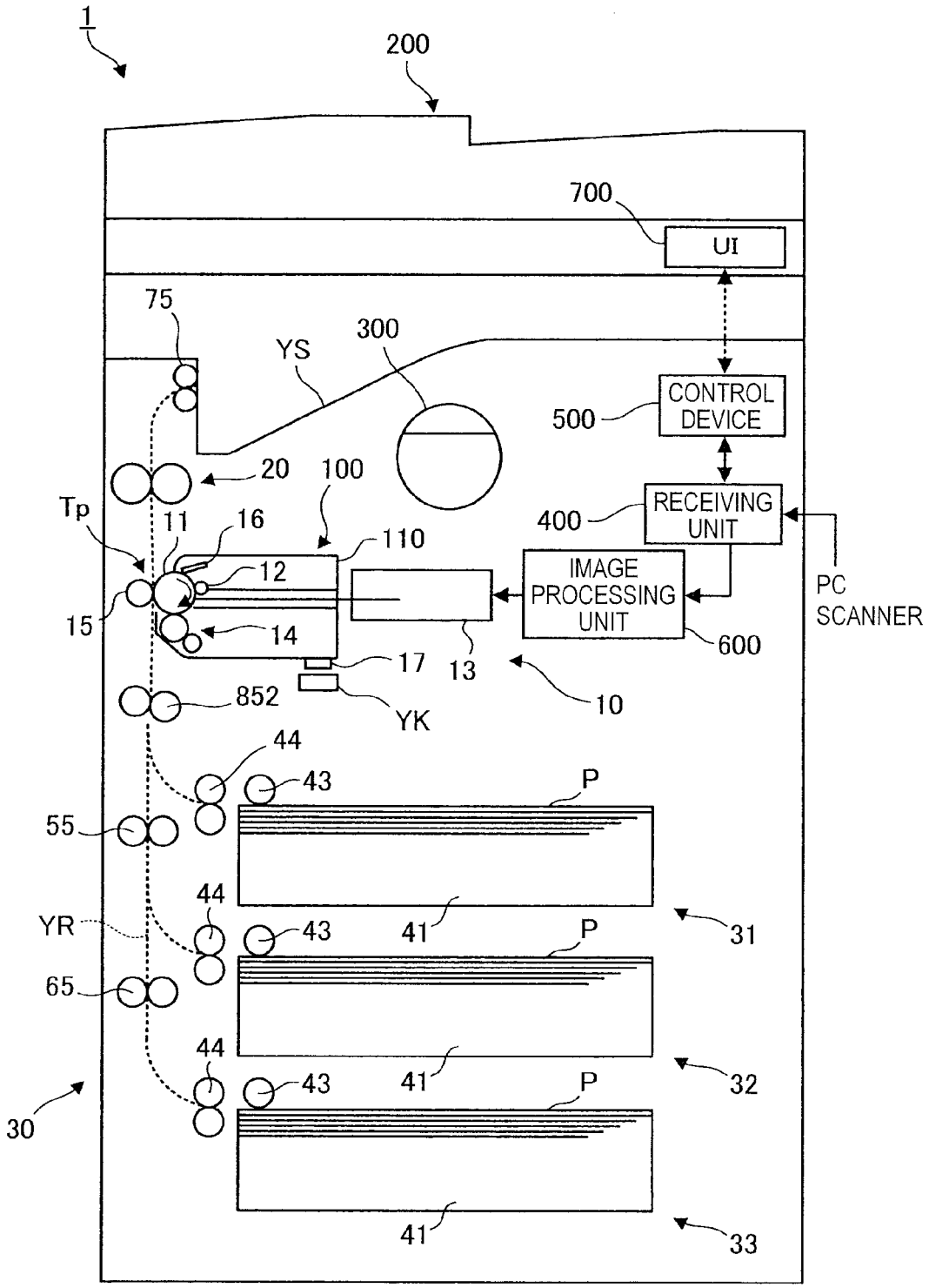
FIG. 1 is a schematic diagram illustrating a configuration of an image forming apparatus.

FIG. 1 is a schematic diagram illustrating a configuration of an image forming apparatus 1.

An image forming unit 10 is provided in the image fouling apparatus 1. The image forming unit 10 forms a toner image (image) on paper P which is an example of a recording material.

A process cartridge 100 as an example of the image forming unit is provided in the image forming unit 10.

A fixing device 20 is provided in the image forming apparatus 1. The fixing device 20 heats and presses a toner image formed on paper P by the image forming unit 10, so as to fix the toner image to the paper P.

A paper supply unit 30 is further provided in the image forming apparatus 1. The paper supply unit 30 supplies paper P to the image fouling unit 10.

The process cartridge 100 as an example of a detachable body is drawn to the front side (front side in the drawing) of the image forming apparatus 1, and thus, is extracted from the image forming apparatus 1.

In the exemplary embodiment, the process cartridge 100 is inserted toward the rear side of the image forming apparatus 1 so as to mount the process cartridge 100 into the image fouling apparatus 1.

A cartridge main body 110 as a main body of the detachable body is provided in the process cartridge 100. In the exemplary embodiment, the cartridge main body 110 is grasped by a user, and the cartridge main body 110 is detachably attached to the image forming apparatus 1.

A photoconductor drum 11 as an example of an image carrier is provided in the cartridge main body 110. A charging device 12, a developing device 14, and a cleaning member 16 are attached to the cartridge main body 110.

A storage medium 17 is attached to the cartridge main body 110. The storage medium 17 may include an electrically erasable and programmable ROM (EEPROM) and the like.

The storage medium 17 as an example of a memory stores information indicating the type of the process cartridge 100. The storage medium 17 stores information indicating a use status of the process cartridge 100, such as the number of rotations of the photoconductor drum 11.

The storage medium 17 stores physical property information and dimension information of the cleaning member 16. More specifically, the storage medium 17 stores hardness or a Young's modulus of the cleaning member 16, as the physical property information of the cleaning member 16. The storage medium 17 stores a length dimension, a width dimension, and a thickness dimension of the cleaning member 16, as the dimension information of the cleaning member 16.

Here, the length dimension of the cleaning member 16 indicates the length of the cleaning member 16 in a direction (shaft direction of the photoconductor drum 11) which is orthogonal to the surface of paper of FIG. 1. In other words, the length dimension of the cleaning member 16 indicates the length of the longest side among three types of sides provided in the cleaning member 16 which is formed so as to be rectangular parallelepiped.

The width dimension of the cleaning member 16 indicates the length of the second longest side among the three types of sides. The thickness dimension of the cleaning member 16 indicates the length of the shortest side among the three types of sides.

An exposure device 13 and a transfer device 15 are provided in the image forming apparatus 1 of the exemplary embodiment. Further, a reading and writing device YK is provided in the image forming apparatus 1. The reading and writing device YK reads information from the storage medium 17 and writes information in the storage medium 17.

The photoconductor drum 11 provided in the process cartridge 100 rotates in a direction indicated by an arrow in the drawing. The charging device 12 charges the photoconductor drum 11 so as to have a predetermined potential.

The exposure device 13 irradiates the photoconductor drum 11 with a laser beam, selectively exposes the photoconductor drum 11 which is charged by the charging device 12, and forms an electrostatic latent image on the photoconductor drum 11.

The developing device 14 causes a toner to adhere to the electrostatic latent image which has been formed on the photoconductor drum 11, so as to form a toner image on the photoconductor drum 11.

For example, a two-component developer is accommodated in the developing device 14. The two-component developer is formed from a toner which is negatively charged, and a carrier which is positively charged. The developing device 14 develops the electrostatic latent image which has been formed on the photoconductor drum 11, by using the toner, and thus forms a toner image on the photoconductor drum 11.

The transfer device 15 forms an electric field (at a transfer portion Tp which is positioned) between the transfer device 15 and the photoconductor drum 11. The transfer device 15 transfers the toner image (toner image held by the photoconductor drum 11) on the photoconductor drum 11, to paper P.

The cleaning member 16 as an example of a cleaning member is formed so as to have a plate shape (configured by so-called a cleaning blade), and is disposed so as to be in contact with the photoconductor drum 11. The cleaning member 16 removes the toner and the like on the photoconductor drum 11.

A first feeding unit 31 to a third feeding unit 33 are provided in the paper supply unit 30 so as to be able to supply sheets of paper P having different sizes to the image forming unit 10.

The first feeding unit 31 to the third feeding unit 33 are similarly configured. If the first feeding unit 31 will be described as an example, the first feeding unit 31 includes a paper accommodation unit 41 that accommodates paper P, a pull-in roll 43, and a separation mechanism 44.

The paper accommodation unit 41 has an opening at an upper portion, and has a rectangular parallelepiped shape. The paper accommodation unit 41 accommodates plural sheets of paper P therein.

The pull-in roll 43 contacts with the top paper P in a paper bundle which is accommodated in the paper accommodation unit 41, and sends the top paper P to the separation mechanism 44.

The separation mechanism 44 is configured, for example, by a feed roll and a retard roll. The feed roll is allowed to be rotated. Rotation of the retard roll is restricted. Sheets of paper P sent by the pull-in roll 43 are separated one by one.

A registration roll (registration roll) 852 is provided in the paper supply unit 30. The registration roll 852 temporarily stops transporting of the paper P in a state of stopping rotation, and performs rotation at a predetermined timing. Thus, the registration roll 852 supplies the paper P while registration adjustment is performed for the transfer portion Tp.

A first transport roll 55 and a second transport roll 65 are provided in the paper supply unit 30. The first transport roll 55 transports the paper P which has been transported from the second feeding unit 32 toward the registration roll 852. The second transport roll 65 transports the paper P which has been transported from the third feeding unit 33 toward the first transport roll 55.

A paper stacking portion YS and a paper transporting path YR are provided in the image forming apparatus 1. The paper P which has passed through the fixing device 20 is stacked at the paper stacking portion YS. The paper P is transported on the paper transporting path YR.

A user interface (UI) 700 is provided in the image forming apparatus 1.

The UI 700 includes, for example, a touch panel. The UI 700 receives an instruction from a user and displays information for the user.

A scanner device (image reading device) 200 is provided at an upper portion of the image forming apparatus 1. A receiving unit 400 is provided in the image forming apparatus 1. The receiving unit 400 receives image data from the scanner device 200 or a personal computer (PC) (not illustrated).

A control device 500 and an image processing unit 600 are provided in the image forming apparatus 1.

The control device 500 controls operations of the units of the scanner device 200, the image forming unit 10, the fixing device 20, and the paper supply unit 30.

The image processing unit 600 performs image processing on the image data which has been received by the receiving unit 400. The image processing unit 600 outputs image data obtained after the image processing is performed, to the exposure device 13.

The control device 500 includes a central processing unit (CPU), a read only memory (ROM), a random access memory (RAM), and a hard disk drive (HDD) (none illustrated). A program is executed by the CPU. The ROM stores various programs, various tables, various parameters, and the like. The RAM is used as a work area when the CPU executes a program.

In the exemplary embodiment, the CPU executes a predetermined program, and thus the control device 500 functions as a controller and an acquisition unit (which will be described later).

Figure 2:
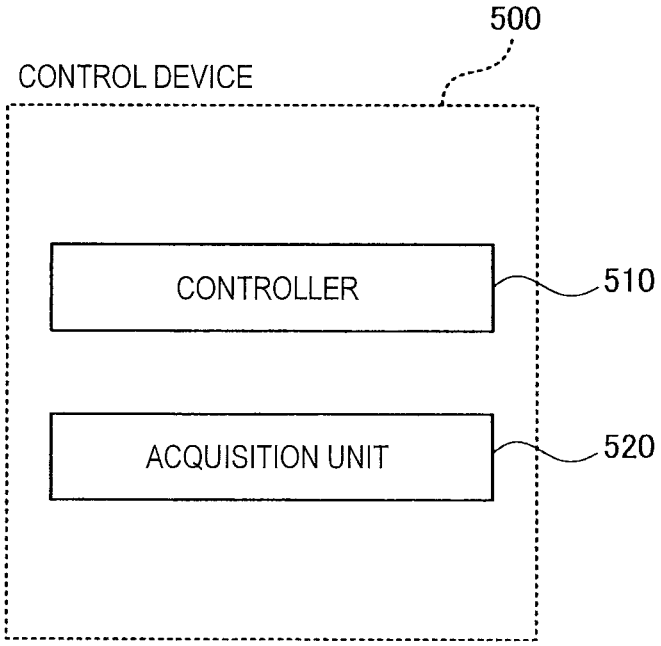
FIG. 2 is a diagram illustrating functional blocks of a control device.

FIG. 2 is a diagram illustrating functional blocks of the control device 500.

In the exemplary embodiment, as described above, the CPU executes a predetermined program, and thus the control device 500 functions as a controller 510 and an acquisition unit 520.

The controller 510 controls operations of the units of the scanner device 200, the image forming unit 10, the fixing device 20, and the paper supply unit 30. The acquisition unit 520 acquires information which has been read from the storage medium 17 by the reading and writing device YK, from the reading and writing device YK.

An operation of the image forming apparatus 1 will be described.

In order to form an image onto paper P, firstly, image data which has been transmitted from a personal computer (not illustrated) or the scanner device 200 is received by the receiving unit 400.

Then, the image data is output to the image processing unit 600 from the receiving unit 400. The image processing unit 600 performs image processing on the image data.

The image data which has been subjected to image processing is output to the exposure device 13. The exposure device 13 selectively exposes the photoconductor drum 11 which has been charged by the charging device 12, based on the image data, and thus forms an electrostatic latent image on the photoconductor drum 11. The electrostatic latent image which has been formed is developed as, for example, a black (K) toner image by the developing device 14.

In the paper supply unit 30, the pull-in roll 43 is rotated at a timing when the image is formed, and thus paper P is supplied to the separation mechanism 44 from the paper accommodation unit 41.

In the separation mechanism 44, sheets of paper P are separated. The paper P which has been separated one by one is transported to the stopped registration roll 852. Then, the registration roll 852 is rotated at a rotation timing of the photoconductor drum 11, and the paper P is supplied to the transfer portion Tp.

The toner image on the photoconductor drum 11 is transferred to the paper P at the transfer portion Tp. If the toner image on the photoconductor drum 11 is transferred to the paper P, the cleaning member 16 cleans the photoconductor drum 11.

Then, the fixing device 20 performs fixing processing on the paper P, and an exit roll 75 performs exiting of the paper P to the paper stacking portion YS.

In the exemplary embodiment, the controller 510 as an example of the controller controls the image forming unit 10 based on physical property information and dimension information of the cleaning member 16.

More specifically, the controller 510 controls the image forming unit 10 based on the physical property information and the dimension information of the cleaning member 16, which are stored in the storage medium 17.

In other words, the controller 510 sets an image forming condition used when the image forming unit 10 forms an image, based on the physical property information and the dimension information of the cleaning member 16.

Thus, in the exemplary embodiment, the occurrence of a defect due to the cleaning member 16 is suppressed.

More specifically, the controller 510 controls (sets) a charging voltage used when the charging device 12 charges the photoconductor drum 11, based on the physical property information and the dimension information of the cleaning member 16.

Thus, an amount of the toner adhering to a non-image forming portion of the photoconductor drum 11 is changed. Accordingly, the occurrence of a blemish (blemish on a surface of the photoconductor drum 11) due to slipping of an external additive and the like is unlikely, or causing abrasion of the photoconductor drum 11 is unlikely.

Figure 3:
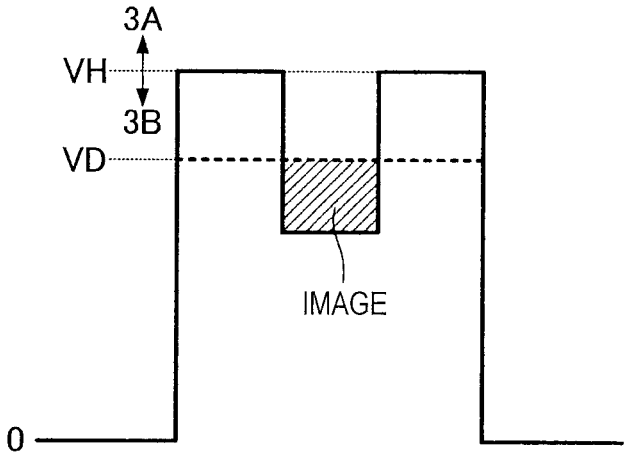
FIG. 3 is a diagram illustrating charging control performed by a controller.

In more detail, the controller 510 increases a charging voltage VH or decreases the charging voltage VH, as indicated by arrows 3A and 3B in FIG. 3 (figure illustrating charging control by the controller 510), so as to control the amount of the toner adhering to the photoconductor drum 11.

If the charging voltage VH is high, the occurrence of so-called blurring is unlikely, and the amount of the toner adhering to the photoconductor drum 11 is reduced (the amount of the toner adhering to a portion (non-image forming portion) of the photoconductor drum 11, at which an image is not formed).

On the contrary, if the charging voltage VH is low, so-called blurring easily occurs, and the amount of the toner adhering to the photoconductor drum 11 is increased (the amount of the toner adhering to the non-image forming portion is increased).

In FIG. 3, VD indicates a developing voltage.

In further detail, the controller 510 in the exemplary embodiment determines an extent of the cleaning member 16 being pressed on the photoconductor drum 11, based on the physical property information and the dimension information of the cleaning member 16.

Here, for example, in a case where the hardness of the cleaning member 16 is small, and the thickness or the width dimension of the cleaning member 16 is small, the controller 510 determines that the extent of the cleaning member 16 being pressed on the photoconductor drum 11 is small.

On the contrary, for example, in a case where the hardness of the cleaning member 16 is large, and the thickness or the width dimension of the cleaning member 16 is large, the controller 510 determines that the extent of the cleaning member 16 being pressed on the photoconductor drum 11 is large.

In a case where the controller 510 determines that the extent of the cleaning member 16 being pressed on the photoconductor drum 11 is small (case where the controller 510 determines that the extent of being pressed is smaller than a predetermined extent), the controller 510 increases the charging voltage VH and decreases the amount of the toner adhering to the photoconductor drum 11.

In a case where the controller 510 determines that the extent of the cleaning member 16 being pressed on the photoconductor drum 11 is large (case where the controller 510 determines that the extent of being pressed is larger than a predetermined extent), the controller 510 reduces the charging voltage VH and increases the amount of the toner adhering to the photoconductor drum 11.

In a case where the extent of the cleaning member 16 being pressed onto the photoconductor drum 11 is small, an external additive and the like which have been added to the toner easily slips between the photoconductor drum 11 and the cleaning member 16. If slipping of the external additive and the like occurs, the surface of the photoconductor drum 11 is rubbed with the external additive and the like. Thus, a blemish easily occurs on the surface of the photoconductor drum 11.

In this case, as described above, if the charging voltage VH is increased and the amount of the toner adhering to the photoconductor drum 11 is decreased, the amount of the slipping external additive and the like is decreased, and the occurrence of a blemish on the surface of the photoconductor drum 11 is unlikely.

In the above descriptions, the charging voltage VH is increased in a case where the extent of the cleaning member 16 being pressed onto the photoconductor drum 11 is small. However, it is not limited to the increase of the charging voltage VH, and a charging current which flows when charging is performed may be increased. If the charging current is high, an amount of a discharge product adhering to the surface of the photoconductor drum 11 is increased, and a degree of adhesion between the photoconductor drum 11 and the cleaning member 16 is increased. In this case, slipping of the external additive and the like between the photoconductor drum 11 and the cleaning member 16 is unlikely. Similar to the above descriptions, the occurrence of a blemish on the surface of the photoconductor drum 11 is unlikely.

In a case where the controller 510 determines that the extent of the cleaning member 16 being pressed on the photoconductor drum 11 is large, the controller 510 reduces the charging voltage VH and increases the amount of the toner adhering to the photoconductor drum 11.

Thus, the toner functioning as a lubricant is further supplied to a contact portion between the photoconductor drum 11 and the cleaning member 16. Thus, occurrence of abrasion of the photoconductor drum 11 is suppressed.

In a case where the extent of the cleaning member 16 being pressed onto the photoconductor drum 11 is large, a friction force which acts between the photoconductor drum 11 and the cleaning member 16 is increased, and the abrasion of the photoconductor drum 11 is easily accelerated.

As in the exemplary embodiment, if a toner is supplied to the contact portion between the photoconductor drum 11 and the cleaning member 16, the occurrence of the abrasion of the photoconductor drum 11 is suppressed.

Other Processing 1 Performed by Controller 510

The controller 510 may control adhering of particles (polishing particles) to the photoconductor drum 11, based on the physical property information and the dimension information of the cleaning member 16.

Here, the image forming unit 10 according to the exemplary embodiment is configured so as to enable particles for polishing the surface of the photoconductor drum 11 to adhere to the surface of the photoconductor drum 11.

More specifically, a carrier containing metal powder is provided in the developing device 14 (see FIG. 1). In the image forming unit 10, a potential between the photoconductor drum 11 and the developing device 14 is controlled, and thus the carrier is adhered to the surface of the photoconductor drum 11.

If the carrier is adhered to the photoconductor drum 11, the surface of the photoconductor drum 11 is scraped by the carrier, when the carrier reaches a space between the photoconductor drum 11 and the cleaning member 16.

Thus, a blemish of the photoconductor drum 11, which occurs by the slipping of the external additive and the like becomes shallow.

More specifically, similar to the above descriptions, the controller 510 finds out the extent of the cleaning member 16 being pressed on the photoconductor drum 11, based on the physical property information and the dimension information of the cleaning member 16. In a case where the extent of being pressed is smaller than a predetermined extent, the controller 510 controls a potential between the photoconductor drum 11 and the developing device 14, and adheres the carrier in the developing device 14 to the surface of the photoconductor drum 11. More specifically, for example, when a cleaning motor is operated, that is, an image is not formed, the carrier in the developing device 14 is adhered to the surface of the photoconductor drum 11.

Thus, the surface of the photoconductor drum 11 is scraped, and an extent of a blemish occurring by slipping of the external additive and the like is reduced further.

In the exemplary embodiment, the surface of the photoconductor drum 11 is polished by using the carrier. However, a dedicated abrasive may be prepared, and this abrasive may be adhered to the surface of the photoconductor drum 11.

Other Processing 2 Performed by Controller 510

The controller 510 may set the frequency of causing the toner to adhere to the photoconductor drum 11, based on the physical property information and the dimension information of the cleaning member 16.

Here, the image forming unit 10 according to the exemplary embodiment controls the potential between the photoconductor drum 11 and the developing device 14, causes the toner to adhere to the photoconductor drum 11, and forms a so-called toner band (band-like toner image) on the surface of the photoconductor drum 11. The image forming unit 10 performs the control, the adhering, and the forming at a predetermined time.

The controller 510 sets the frequency of the toner band being formed, based on the physical property information and the dimension information of the cleaning member 16.

More specifically, similar to the above descriptions, the controller 510 determines the extent of the cleaning member 16 being pressed on the photoconductor drum 11, based on the physical property information and the dimension information of the cleaning member 16.

In a case where the extent of being pressed is larger than a predetermined extent, the controller 510 sets the frequency of forming the toner band, so as to increase the frequency of forming the toner band.

Thus, the toner functioning as a lubricant is further supplied to the contact portion between the photoconductor drum 11 and the cleaning member 16, at a higher frequency. Thus, the occurrence of abrasion of the photoconductor drum 11 is suppressed.

Other Processing 3 Performed by Controller 510

The controller 510 may set a threshold value based on the physical property information and the dimension information of the cleaning member 16. The threshold value is used for determining a lifetime of the photoconductor drum 11.

The controller 510 in the exemplary embodiment compares a use status of the photoconductor drum 11 to the predetermined threshold value, and determines the lifetime of the photoconductor drum 11.

Specifically, the controller 510 finds out the use status of the photoconductor drum 11 based on information such as the number of sheets on which printing is performed, or the number of rotations of the photoconductor drum 11. The controller 510 compares the found use status and the predetermined threshold value, and determines whether or not the photoconductor drum 11 reaches the lifetime.

More specifically, the controller 510 determines whether or not the found use status reaches the predetermined threshold value. In a case where the use status reaches the threshold value, the controller 510 determines that the photoconductor drum 11 reaches the lifetime.

Further, the controller 510 sets the threshold value which is used for determining the lifetime of the photoconductor drum 11, based on the physical property information and the dimension information of the cleaning member 16.

Specifically, similar to the above descriptions, the controller 510 finds out the extent of the cleaning member 16 being pressed on the photoconductor drum 11, based on the physical property information and the dimension information of the cleaning member 16. In a case where the extent of being pressed is smaller than a predetermined extent, the controller 510 sets the threshold value used for determining the lifetime of the photoconductor drum 11, to a large value.

In a case where the extent of being pressed is larger than the predetermined extent, the controller 510 sets the threshold value used for determining the lifetime of the photoconductor drum 11, to a value which is smaller than that in a case where the extent of being pressed is small.

Others

In the above descriptions, the image forming unit 10 is controlled by using both of the physical property information and the dimension information of the cleaning member 16. However, the image forming unit 10 may be controlled by only using either of the physical property information and the dimension information of the cleaning member 16.

In the above descriptions, a monochromatic image forming apparatus is described as an example. However, the components and processing described above may be applied to a color image forming apparatus such as a so-called tandem type image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit comprising an image carrier and a cleaning member that cleans the image carrier, to form an image on a recording material; and at least one central processing unit configured to implement a controller that controls the image forming unit based on at least one of physical property information and dimension information of the cleaning member, wherein the image forming unit causes a toner to adhere to the image carrier at a predetermined time to form a toner band onto the image carrier, and the controller sets a frequency at which the image forming unit causes the toner band to be formed onto the image carrier, based on the at least one of the physical property information and the dimension information.

2. The image forming apparatus according to claim 1, wherein the controller sets an image forming condition that is used when the image forming unit forms an image, based on the at least one of the physical property information and the dimension information.

3. The image forming apparatus according to claim 1, wherein the image forming unit causes a toner to adhere to the image carrier so as to form a toner image on the image carrier, and transfers the formed toner image to the recording material so as to form the image on the recording material, and the controller controls an amount of the toner adhering to the image carrier, based on the at least one of the physical property information and the dimension information.

4. The image forming apparatus according to claim 1, wherein the image forming unit is configured to enable particles that polish a surface of the image carrier to adhere to the surface of the image carrier, and the controller controls the image forming unit to cause the particles to adhere to the image carrier, based on the at least one of the physical property information and the dimension information.

5. The image forming apparatus according to claim 1, wherein the controller compares a use status of the image carrier to a predetermined threshold value to determine a lifetime of the image carrier, and sets the threshold value used for determining the lifetime, based on the at least one of the physical property information and the dimension information.

6. A non-transitory computer readable medium storing a program causing a computer to perform processing comprising:

acquiring at least one of physical property information and dimension information of a cleaning member that cleans an image carrier provided in an image forming unit; and controlling the image forming unit based on the acquired at least one of the physical property information and the dimension information;

causing a toner to adhere to the image carrier at a predetermined time to form a toner band onto the image carrier; and setting a frequency at which the image forming unit causes the toner band to be formed onto the image carrier, based on the at least one of the physical property information and the dimension information.

7. A method comprising:

acquiring at least one of physical property information and dimension information of a cleaning member that cleans an image carrier provided in an image forming unit;

controlling the image forming unit based on the acquired at least one of the physical property information and the dimension information;

causing a toner to adhere to the image carrier at a predetermined time to form a toner band onto the image carrier; and setting a frequency at which the image forming unit causes the toner band to be formed onto the image carrier, based on the at least one of the physical property information and the dimension information.

* * * * *